US007781385B2

(12) United States Patent
Dodd et al.

(10) Patent No.: US 7,781,385 B2
(45) Date of Patent: Aug. 24, 2010

(54) LUBRICATING OIL COMPOSITION

(75) Inventors: James C. Dodd, Didcot (GB); Fredrick W. Girshick, Scotch Plains, NJ (US); Michael D. Hoey, Maplewood, NJ (US); Jeremy R. Spencer, Didcot (GB)

(73) Assignee: Infineum International Limited (GB)

( * ) Notice: Subject to any disclaimer, the term of this patent is extended or adjusted under 35 U.S.C. 154(b) by 968 days.

(21) Appl. No.: 11/500,730

(22) Filed: Aug. 8, 2006

(65) Prior Publication Data

US 2008/0039349 A1 Feb. 14, 2008

(51) Int. Cl.
*C10M 145/18* (2006.01)
*C10M 151/04* (2006.01)
*C10M 129/26* (2006.01)

(52) U.S. Cl. ..... 508/580; 508/460; 508/567

(58) Field of Classification Search ..... 508/580, 508/460, 567

See application file for complete search history.

(56) References Cited

U.S. PATENT DOCUMENTS

| | | | | |
|---|---|---|---|---|
| 1,815,022 | A | 7/1931 | Davis | |
| 2,978,423 | A | 4/1961 | Tirtiaux et al. | |
| 3,057,801 | A | 10/1962 | Wilgus | 252/59 |
| 4,163,731 | A * | 8/1979 | Randell et al. | 252/78.5 |
| 4,708,809 | A | 11/1987 | Davis | 252/33.4 |
| 4,800,032 | A | 1/1989 | Murphy | 252/51.5 A |
| 4,948,522 | A * | 8/1990 | Dunn et al. | 508/192 |
| 5,021,498 | A | 6/1991 | Stephenson et al. | |
| 5,059,723 | A | 10/1991 | Dressler | 568/45 |
| 5,679,871 | A | 10/1997 | Nava | 568/648 |
| 5,821,202 | A | 10/1998 | Forester et al. | |
| 6,495,496 | B2 | 12/2002 | Gutierrez et al. | 508/561 |
| 6,498,278 | B1 | 12/2002 | Clements et al. | 568/630 |
| 6,750,183 | B2 | 6/2004 | Gutierrez et al. | 508/329 |
| 2005/0119140 | A1 * | 6/2005 | Chambard et al. | 508/572 |
| 2006/0189492 | A1 | 8/2006 | Bera et al. | |

FOREIGN PATENT DOCUMENTS

| | | | |
|---|---|---|---|
| EP | 0 324 828 | B1 | 8/1992 |
| EP | 1605034 | A1 | 12/2005 |
| EP | 1693434 | A2 | 8/2006 |
| EP | 1767611 | A2 | 3/2007 |
| JP | 03-052838 | | 3/1991 |
| JP | 2789693 | | 8/1998 |
| JP | 2004107266 | | 4/2004 |
| RO | 105571 | B1 | 9/1992 |

* cited by examiner

*Primary Examiner*—Michael Marcheschi
*Assistant Examiner*—Jim Goloboy

(57) ABSTRACT

A lubricating oil composition having a total base number of more than 15 mg KOH/g, as determined by ASTM D2896, and including at least 40 mass % of an oil of lubricating viscosity; at least one detergent; and at least one compound of the formula (II):

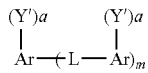

(II)

In formula (II), each Ar independently represents an aromatic moiety having 0 to 3 substituents selected from the group consisting of alkyl, alkoxy, alkoxyalkyl, hydroxy, hydroxyalkyl, acyloxy, acyloxyalkyl, aryloxy, aryloxy alkyl, halo and combinations thereof; each L is independently a linking moiety comprising a carbon-carbon single bond or a linking group; each Y' is independently a moiety of the formula $Z(O(CR_2)_n)_yX$—, wherein X is selected from the group consisting of $(CR'_2)_z$, O and S; R and R' are each independently selected from H, $C_1$ to $C_6$ alkyl and aryl; z is 1 to 10; n is 0 to 10 when X is $(CR'_2)_z$, and 2 to 10 when X is O or S; y is 1 to 30; Z is H, an acyl group, an alkyl group or an aryl group; each a is independently 0 to 3, with the proviso that at least one Ar moiety bears at least one group Y' in which Z is not H; and m is 1 to 100.

19 Claims, No Drawings

LUBRICATING OIL COMPOSITION

This invention concerns lubricating oil compositions. In particular, this invention concerns lubricating oil compositions for diesel engines, more specifically trunk piston diesel engine lubricating oil compositions (or trunk piston engine oil ('TPEO')) and system oils for crosshead (also referred to as two-stroke or slow speed) diesel engines.

Trunk piston diesel engines are used in marine, power generation and rail traction applications and have a rated speed of between 300 and 1000 rpm. In trunk piston diesel engines a single lubricant composition is used for crankcase and cylinder lubrication. All major moving parts of the engine, i.e. the main and big end bearings, camshaft and valve gear, are lubricated by a pumped circulation system. The cylinder liners are lubricated partially by splash lubrication and partially by oil from the circulation system which finds its way to the cylinder wall through holes in the piston skirt via the connecting rod and gudgeon pin. Crosshead diesel engines, on the other hand, are lubricated using two separate lubricants; the engine cylinders are lubricated using a marine diesel cylinder lubricant (or 'MDCL'), and the engine crankcase is lubricated using a separate lubricant referred to as a system oil.

Trunk piston diesel engines use a centrifuge system to remove contaminants such as, for example, soot or water, from the lubricating oil composition. Similar centrifuge systems are used to treat the system oil of some crosshead marine diesel engines. The centrifuge system relies on the use of a sealing medium that is heavier than the lubricating oil composition. The sealing medium is generally water. When the lubricating oil composition passes through the centrifuge system, it comes into contact with the water. The lubricating oil composition therefore needs to be capable of shedding the water and remaining stable in the presence of water. If the lubricating oil composition is unable to shed the water, the water builds up in the lubricating oil composition forming an emulsion, which leads to deposits building up in the centrifuge system and prevents the centrifuge system from working properly.

An aim of the present invention is to provide a lubricating oil composition that is capable of shedding mediums used in centrifuge systems.

Marine trunk piston engines operate on residual fuels which contain high concentrations of asphaltenes. These engines have integral engine oil sumps which introduce asphaltenes into the engine lubricating oil. Asphaltenes are high molecular weight compounds with multiple fused aromatic rings, and are generally insoluble in lubricating oils. As such, they 'plate out' on to the engine surfaces causing harmful deposits. Trunk piston engines perform better when they are able to solubilise the asphaltenes.

A further aim of the present invention is to provide a lubricating oil composition that exhibits improved asphaltene dispersancy.

In accordance with the present invention, there is provided a lubricating oil composition having a total base number of at least 15 mg KOH/g, as determined by ASTM D2896, the composition including:

at least 40 mass % of an oil of lubricating viscosity;

at least one overbased metal detergent; and at least one compound of the formula:

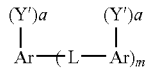

(II)

wherein:

each Ar independently represents an aromatic moiety having 0 to 3 substituents selected from the group consisting of alkyl, alkoxy, alkoxyalkyl, hydroxy, hydroxyalkyl, acyloxy, acyloxyalkyl, aryloxy, aryloxy alkyl, halo and combinations thereof;

each L is independently a linking moiety comprising a carbon-carbon single bond or a linking group;

each Y' is independently a moiety of the formula $Z(O(CR_2)_n)_yX$—, wherein X is selected from the group consisting of $(CR'_2)_z$, O and S; R and R' are each independently selected from H, $C_1$ to $C_6$ alkyl and aryl; z is 1 to 10; n is 0 to 10 when X is $(CR'_2)_z$, and 2 to 10 when X is O or S; y is 1 to 30; Z is H, an acyl group, an alkyl group or an aryl group;

each a is independently 0 to 3, with the proviso that at least one Ar moiety bears at least one group Y' in which Z is not H; and m is 1 to 100.

In accordance with the present invention there is also provided a method of operating a trunk piston diesel engine having a centrifuge system including a sealing medium, the method including the step of lubricating the engine with the lubricating oil composition defined above. The sealing medium is preferably water.

In accordance with the present invention there is also provided a method of operating a crosshead diesel engine having a centrifuge system including a sealing medium, the method including the step of lubricating the engine crankcase with the lubricating oil composition defined above. The sealing medium is preferably water.

In accordance with the present invention there is also provided use of the lubricating oil composition defined above to lubricate a trunk piston diesel engine and to reduce deposits.

In accordance with the present invention there is also provided use of the lubricating oil composition defined above to lubricate the crankcase of a crosshead diesel engine and to reduce deposits.

In accordance with the present invention there is also provided use of the lubricating oil composition defined above to improve asphaltene dispersancy in a trunk piston diesel engine.

Compounds of Formula (II) are described in co-pending U.S. patent application Ser. No. 11/061,800, filed Feb. 18, 2005, the subject matter of which is incorporated herein by reference. Compounds of Formula (II) can be prepared from compounds of formula (I) which are defined by the formula:

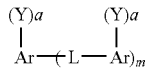

(I)

wherein each Ar independently represents an aromatic moiety having 0 to 3 substituents selected from the group consisting of alkyl, alkoxy, alkoxyalkyl, hydroxy, hydroxyalkyl, halo and combinations thereof; each L is independently a linking moiety comprising a carbon-carbon single bond or a linking group; each Y is independently a moiety of the formula $H(O(CR_2)_n)_yX$—, wherein X is selected from the group consisting of $(CR'_2)_z$, O and S; R and R' are each independently selected from H, $C_1$ to $C_6$ alkyl and aryl; z is 1 to 10; n is 0 to 10 when X is $(CR'_2)_z$, and 2 to 10 when X is O or S; and y is 1 to 30; each a is independently 0 to 3, with the proviso that at least one Ar moiety bears at least one group Y; and m is 1 to 100.

Aromatic moieties Ar of Formula (I) can be a mononuclear carbocyclic moiety (phenyl) or a polynuclear carbocyclic moiety. Polynuclear carbocyclic moieties may comprise two or more fused rings, each ring having 4 to 10 carbon atoms (e.g., naphthalene) or may be linked mononuclear aromatic moieties, such as biphenyl, or may comprise linked, fused rings (e.g., binaphthyl). Examples of suitable polynuclear carbocyclic aromatic moieties include naphthalene, anthracene, phenanthrene, cyclopentenophenanthrene, benzanthracene, dibenzanthracene, chrysene, pyrene, benzpyrene and coronene and dimer, trimer and higher polymers thereof. Ar can also represent a mono- or polynuclear heterocyclic moiety. Heterocyclic moieties Ar include those comprising one or more rings each containing 4 to 10 atoms, including one or more hetero atoms selected from N, O and S. Examples of suitable monocyclic heterocyclic aromatic moieties include pyrrole, furan, thiophene, imidazole, oxazole, thiazole, pyrazole, pyridine, pyrimidine and purine. Suitable polynuclear heterocyclic moieties Ar include, for example, quinoline, isoquinoline, carbazole, dipyridyl, cinnoline, phthalazine, quinazoline, quinoxaline and phenanthroline. Each aromatic moiety (Ar) may be independently selected such that all moieties Ar are the same or different. Polycyclic carbocyclic aromatic moieties are preferred. Most preferred are compounds of Formula I wherein each Ar is naphthalene. Each aromatic moiety Ar may independently be unsubstituted or substituted with 1 to 3 substituents selected from alkyl, alkoxy alkoxyalkyl, hydroxyl, hydroxyalkyl, halo, and combinations thereof. Preferably, each Ar is unsubstituted (except for group(s) Y and terminal groups).

Each linking group (L) may be the same or different, and can be a carbon to carbon single bond between the carbon atoms of adjacent moieties Ar, or a linking group. Suitable linking groups include alkylene linkages, ether linkages, diacyl linkages, ether-acyl linkages, amino linkages, amido linkages, carbamido linkages, urethane linkages, and sulfur linkage. Preferred linking groups are alkylene linkages such as —$CH_3CHC(CH_3)_2$—, or $C(CH_3)_2$—; diacyl linkages such as —COCO— or —$CO(CH_2)_4CO$—; and sulfur linkages, such as —$S_1$— or —$S_x$—. More preferred linking groups are alkylene linkages, most preferably —$CH_2$—.

Preferably, Ar of Formula (I) represents naphthalene, and more preferably, Ar is derived from 2-(2-naphthyloxy)-ethanol. Preferably, each Ar is derived from 2-(2-naphthyloxy)-ethanol, and m is 2 to 25. Preferably, Y of Formula (I) is the group $H(O(CR_2)_2)_yO$—, wherein y is 1 to 6. More preferably, Ar is naphthalene, Y is $HOCH_2CH_2O$— and L is —$CH_2$—.

Methods for forming compounds of Formula (I) should be apparent to those skilled in the art. A hydroxyl aromatic compound, such as naphthol can be reacted with an alkylene carbonate (e.g., ethylene carbonate) to provide a compound of the formula AR—$(Y)_a$. Preferably, the hydroxyl aromatic compound and alkylene carbonate are reacted in the presence of a base catalyst, such as aqueous sodium hydroxide, and at a temperature of from about 25 to about 300° C., preferably at a temperature of from about 50 to about 200° C. During the reaction, water may be removed from the reaction mixture by azeotropic distillation or other conventional means. If separation of the resulting intermediate product is desired, upon completion of the reaction (indicated by the cessation of $CO_2$ evolution), the reaction product can be collected, and cooled to solidify. Alternatively, a hydroxyl aromatic compound, such as naphthol, can be reacted with an epoxide, such as ethylene oxide, propylene oxide, butylenes oxide or styrene oxide, under similar conditions to incorporate one or more oxy-alkylene groups.

To form a compound of Formula (I), the resulting intermediate compound Ar—$(Y)_a$ may be further reacted with a polyhalogenated (preferably dihalogenated) hydrocarbon (e.g., 1-4-dichlorobutane, 2,2-dichloropropane, etc.), or a di- or poly-olefin (e.g., butadiene, isoprene, divinylbenzene, 1,4-hexadiene, 1,5-hexadiene, etc.) to yield a compound of Formula (I) having an alkylene linking groups. Reaction of moieties Ar—$(Y)_a$ and a ketone or aldehyde (e.g., formaldehyde, acetone, benzophenone, acetophenone, etc.) provides an alkylene linked compound. An acyl-linked compound can be formed by reacting moieties Ar—$(Y)_a$ with a diacid or anhydride (e.g., oxalic acid, malonic acid, succinic acid, glutaric acid, adipic acid, succinic anhydride, etc.). Sulfide, polysulfide, sulfinyl and sulfonyl linkages may be provided by reaction of the moieties Ar—$(Y)_a$ with a suitable difunctional sulfurizing agent (e.g., sulfur monochloride, sulfur dichloride, thionyl chloride ($SOCl_2$), sulfuryl chloride ($SO_2Cl_2$), etc.). To provide a compound of Formula (I) with an alkylene ether linkage, moieties Ar—$(Y)_a$ can be reacted with a divinylether. Compounds of Formula (I), wherein L is a direct carbon to carbon link, may be formed via oxidative coupling polymerization using a mixture of aluminum chloride and cuprous chloride, as described, for example, by P. Kovacic, et al., *J. Polymer Science: Polymer Chem. Ed.*, 21, 457 (1983). Alternatively, such compounds may be formed by reacting moieties Ar—$(Y)_a$ and an alkali metal as described, for example, in "Catalytic Benzene Coupling on Caesium/Nanoporous Carbon Catalysts", M. G. Stevens, K. M. Sellers, S. Subramoney and H. C. Foley, *Chemical Communications*, 2679-2680 (1988).

To form the preferred compounds of Formula (I), having an alkylene linking group, more preferably a methylene linking group, base remaining in the Ar—$(Y)_a$ reaction mixture can be neutralized with acid, preferably with an excess of acid (e.g., a sulfonic acid) and reacted with an aldehyde, preferably formaldehyde, and preferably in the presence of residual acid, to provide an alkylene, preferably methylene bridged compound of Formula (I). The degree of polymerization of the compounds of Formula I range from 2 to about 101 (corresponding to a value of m of from 1 to about 100), preferably from about 2 to about 50, most preferably from about 2 to about 25.

The compounds of formula (II) can be formed by reacting a compound of formula (I) with at least one of an acylating agent, an alkylating agent and an arylating agent, and are represented by the formula:

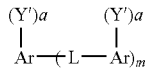

(II)

wherein each Y' is independently a moiety of the formula $Z(O(CR_2)_n)_yX$—; Z is an acyl group, an alkyl group or an aryl group or H, and Ar, L, X, R, z, n and y are the same as defined in Formula (I), with the proviso that, at least one Ar moiety bears at least one substituent group Y' in which Z is not H; and m is 1 to 100.

Suitable acylating agents include hydrocarbyl carbonic acid, hydrocarbyl carbonic acid halides, hydrocarbyl sulfonic acid and hydrocarbyl sulfonic acid halides, hydrocarbyl phosphoric acid and hydrocarbyl phosphoric halides, hydrocarbyl isocyanates and hydrocarbyl succinic acylating agents. Preferred acylating agents are $C_8$ and higher hydrocarbyl isocyanates, such as dodecyl isocyanate and hexadodecyl isocyanate and $C_8$ or higher hydrocarbyl acylating agents, more preferably polybutenyl succinic acylating agents such as polybutenyl, or polyisobutenyl succinic anhydride (PIBSA). Preferably the hydrocarbyl succinic acylating agent will have a number average molecular weight ($\overline{M}_n$) of from about 100 to 5000, preferably from about 200 to about 3000, more preferably from about 450 to about 2500. Preferred hydrocarbyl isocyanate acylating agent will have a number average molecular weight ($\overline{M}_n$) of from about 100 to 5000, preferably from about 200 to about 3000, more preferably from about 200 to about 2000.

Acylating agents can be prepared by conventional methods known to those skilled in the art, such as chlorine-assisted, thermal and radical grafting methods. The acylating agents can be mono- or polyfunctional. Preferably, the acylating agents have a functionality of less than 1.3. Acylating agents are used in the manufacture of dispersants, and a more detailed description of methods for forming acylating agents is described in the description of suitable dispersants, presented infra.

Suitable alkylating agents include $C_8$ to $C_{30}$ alkane alcohols, preferably $C_8$ to $C_{18}$ alkane alcohols. Suitable arylating agents include $C_8$ to $C_{30}$, preferably $C_8$ to $C_{18}$ alkane-substituted aryl mono- or polyhydroxide.

Molar amounts of the compound of Formula (I) and the acylating, alkylating and/or arylating agent can be adjusted such that all, or only a portion, such as 25% or more, 50% or more or 75% or more of groups Y are converted to groups Y'. In the case where the compound of Formula (I) has hydroxy and/or alkyl hydroxy substituents, and such compounds are reacted with an acylating group, it is possible that all or a portion of such hydroxy and/or alkylhydroxy substituents will be converted to acyloxy or acyloxy alkyl groups. In the case where the compound of Formula (I) has hydroxy and/or alkyl hydroxy substituents, and such compounds are reacted with an arylating group, it is possible that all or a portion of such hydroxy and/or alkylhydroxy substituents will be converted to aryloxy or aryloxy alkyl groups. Therefore, compounds of Formula (II) substituted with acyloxy, acyloxy alkyl, aryloxy and/or aryloxy alkyl groups are considered within the scope of the present invention. A salt form of compounds of Formula (II) in which Z is an acylating group, which salts result from neutralization with base (as may occur, for example, due to interaction with a metal detergent, either in an additive package or a formulated lubricant), is also considered to be within the scope of the invention.

Compounds of Formula (II) can be derived from the precursors of Formula (I) by reacting the precursors of Formula (I) with the acylating agent, preferably in the presence of a liquid acid catalyst, such as sulfonic acid, e.g., dodecyl benzene sulfonic acid, paratoluene sulfonic acid or polyphosphoric acid or a solid acid catalyst such as Amberlyst-15, Amberlyst-36, zeolites, mineral acid clay or tungsten polyphosphoric acid; at a temperature of from about 0 to about 300° C., preferably from about 50 to about 250° C. Under the above conditions, the preferred polybutenyl succinic acylating agents can form diesters, acid esters or lactone esters with the compound of Formula (I).

Compounds of Formula (II) can be derived from the precursors of Formula (I) by reacting the precursors of Formula (I) with the alkylating agent or arylating agent, preferably in the presence of triphenylphosphine and diethyl azodicarboxylate (DEAD), a liquid acid catalyst, such as sulfonic acid, e.g., dodecyl benzene sulfonic acid, paratoluene sulfonic acid or polyphosphoric acid or a solid acid catalyst such as Amberlyst-15, Amberlyst-36, zeolites, mineral acid clay or tungsten polyphosphoric acid; at a temperature of from about 0 to about 300° C., preferably from about 50 to about 250° C.

Preferably, the lubricating oil compositions contain from about 0.005 to 15 mass %, preferably from about 0.1 to about 5 mass %, more preferably from about 0.5 to about 2 mass % of a compound of Formula (II).

Oils of lubricating viscosity useful in the context of the present invention may be selected from natural lubricating oils, synthetic lubricating oils and mixtures thereof. The lubricating oil may range in viscosity from light distillate mineral oils to heavy lubricating oils such as gasoline engine oils, mineral lubricating oils and heavy duty diesel oils. Generally, the viscosity of the oil ranges from about 2 centistokes to about 40 centistokes, especially from about 4 centistokes to about 20 centistokes, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof. Also useful are synthetic oils derived from a gas to liquid process from Fischer-Tropsch synthesized hydrocarbons, which are commonly referred to as gas to liquid, or "GTL" base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II or Group III, base stock or base oil blends of the aforementioned base stocks. Preferably, the oil of lubricating viscosity is a Group II or Group III base stock, or a mixture thereof, or a mixture of a Group I base stock and one or more a Group II and Group III. Preferably, a major amount of the oil of lubricating viscosity is a Group II, Group III, Group IV or Group V base stock, or a mixture thereof. The base stock, or base stock blend preferably has a saturate content of at least 65%, more preferably at least 75%, such as at least 85%. Most preferably, the base stock, or base stock blend, has a saturate content of greater than 90%. Preferably, the oil or oil blend will have a sulfur content of less than 1%, preferably less than 0.6%, most preferably less than 0.4%, by weight.

Preferably the volatility of the oil or oil blend, as measured by the Noack volatility test (ASTM D5880), is less than or equal to 30%, preferably less than or equal to 25%, more preferably less than or equal to 20%, most preferably less than or equal 16%. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1.
b) Group II base stocks contain greater than or equal to 90 percent saturates and less than or equal to 0.03 percent sulfur and have a viscosity index greater than or equal to 80 and less than 120 using the test methods specified in Table 1.
c) Group III base stocks contain greater than or equal to 90 percent saturates and less than or equal to 0.03 percent sulfur and have a viscosity index greater than or equal to 120 using the test methods specified in Table 1.
d) Group IV base stocks are polyalphaolefins (PAO).
e) Group V base stocks include all other base stocks not included in Group I, II, III, or IV.

TABLE I

Analytical Methods for Base Stock

| Property | Test Method |
|---|---|
| Saturates | ASTM D 2007 |
| Viscosity Index | ASTM D 2270 |

TABLE I-continued

Analytical Methods for Base Stock

| Property | Test Method |
|---|---|
| Sulfur | ASTM D 2622<br>ASTM D 4294<br>ASTM D 4927<br>ASTM D 3120 |

The lubricating oil composition includes at least one overbased metal detergent. A detergent is an additive that reduces formation of deposits, for example, high-temperature varnish and lacquer deposits, in engines; it has acid-neutralising properties and is capable of keeping finely divided solids in suspension. It is based on metal "soaps"; that is metal salts of acidic organic compounds, sometimes referred to as surfactants.

A detergent comprises a polar head with a long hydrophobic tail. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The detergent is preferably an alkali metal or alkaline earth metal additive such as an overbased oil-soluble or oil-dispersible calcium, magnesium, sodium or barium salt of a surfactant selected from phenol, sulphonic acid, carboxylic acid, salicylic acid and naphthenic acid, wherein the overbasing is provided by an oil-insoluble salt of the metal, e.g. carbonate, basic carbonate, acetate, formate, hydroxide or oxalate, which is stabilised by the oil-soluble salt of the surfactant. The metal of the oil-soluble surfactant salt may be the same or different from that of the metal of the oil-insoluble salt. Preferably the metal, whether the metal of the oil-soluble or oil-insoluble salt, is calcium.

The TBN of the detergent may be low, i.e. less than 50 mg KOH/g, medium, i.e. 50-150 mg KOH/g, or high, i.e. over 150 mg KOH/g, as determined by ASTM D2896. Preferably the TBN is medium or high, i.e. more than 50 TBN. More preferably, the TBN is at least 60, more preferably at least 100, more preferably at least 150, and up to 500, such as up to 350 mg KOH/g, as determined by ASTM D2896.

Surfactants for the surfactant system of the overbased detergent preferably contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impart the desired oil-solubility.

Phenols, for use in preparing the detergents may be non-sulphurized or, preferably, sulphurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols may be derived from the formula

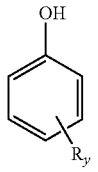

where R represents a hydrocarbyl group and y represents 1 to 4. Where y is greater than 1, the hydrocarbyl groups may be the same or different.

The phenols are frequently used in sulphurized form. Sulphurized hydrocarbyl phenols may typically be represented by the formula:

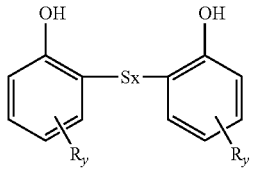

where x is generally from 1 to 4. In some cases, more than two phenol molecules may be linked by $S_x$ bridges.

In the above formulae, hydrocarbyl groups represented by R are advantageously alkyl groups, which advantageously contain 5 to 100, preferably 5 to 40, especially 9 to 12, carbon atoms, the average number of carbon atoms in all of the R groups being at least 9 in order to ensure adequate solubility in oil. Preferred alkyl groups are nonyl (tripropylene) groups.

In the following discussion, hydrocarbyl-substituted phenols will for convenience be referred to as alkyl phenols.

A sulphurizing agent for use in preparing a sulphurized phenol or phenate may be any compound or element which introduces —$(S)_x$— bridging groups between the alkyl phenol monomer groups, wherein x is generally from 1 to about 4. Thus, the reaction may be conducted with elemental sulphur or a halide thereof, for example, sulphur dichloride or, more preferably, sulphur monochloride. If elemental sulphur is used, the sulphurization reaction may be effected by heating the alkyl phenol compound at from 50 to 250, preferably at least 100, ° C. The use of elemental sulphur will typically yield a mixture of bridging groups —(S)x- as described above. If a sulphur halide is used, the sulphurization reaction may be effected by treating the alkyl phenol at from −10 to 120, preferably at least 60, ° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulphur is used as the sulphurizing agent, it may be desirable to use a basic catalyst, for example, sodium hydroxide or an organic amine, preferably a heterocyclic amine (e.g., morpholine).

Details of sulphurization processes are well known to those skilled in the art.

Regardless of the manner in which they are prepared, sulphurized alkyl phenols useful in preparing overbased detergents generally comprise diluent and unreacted alkyl phenols and generally contain from 2 to 20 mass %, preferably 4 to 14 mass %, and most preferably 6 to 12 mass %, sulphur based on the mass of the sulphurized alkyl phenol.

As indicated above, the term "phenol" as used herein includes phenols that have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above provided that such substituents do not detract significantly from the surfactant properties of the phenols. Examples of such substituents are methoxy groups and halogen atoms.

Salicylic acids used in accordance with the invention may be non-sulphurized or sulphurized, and may be chemically modified and/or contain additional substituents, for example, as discussed above for phenols. Processes similar to those described above may also be used for sulphurizing a hydrocarbyl-substituted salicylic acid, and are well known to those skilled in the art. Salicylic acids are typically prepared by the carboxylation, by the Kolbe-Schmitt process, of phenoxides, and in that case, will generally be obtained (normally in a diluent) in admixture with uncarboxylated phenol.

Preferred substituents in oil-soluble salicylic acids from which overbased detergents in accordance with the invention may be derived are the substituents represented by R in the above discussion of phenols. In alkyl-substituted salicylic acids, the alkyl groups advantageously contain 5 to 100, preferably 9 to 30, especially 14 to 20, carbon atoms.

Sulphonic acids used in accordance with the invention are typically obtained by sulphonation of hydrocarbyl-substituted, especially alkyl-substituted, aromatic hydrocarbons, for example, those obtained from the fractionation of petroleum by distillation and/or extraction, or by the alkylation of aromatic hydrocarbons.

Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from 7 to 100 or more carbon atoms. They preferably contain from 16 to 80, or 12 to 40, carbon atoms per alkyl-substituted aromatic moiety, depending on the source from which they are obtained.

When neutralizing these alkylaryl sulphonic acids to provide sulphonates, hydrocarbon solvents and/or diluent oils may also be included in the reaction mixture, as well as promoters and viscosity control agents.

Another type of sulphonic acid that may be used in accordance with the invention comprises alkyl phenol sulphonic acids. Such sulphonic acids can be sulphurized. Whether sulphurized or non-sulphurized these sulphonic acids are believed to have surfactant properties comparable to those of sulphonic acids, rather than surfactant properties comparable to those of phenols.

Sulphonic acids suitable for use in accordance with the invention also include alkyl sulphonic acids, such as alkenyl sulphonic acids. In such compounds the alkyl group suitably contains 9 to 100, advantageously 12 to 80, especially 16 to 60, carbon atoms.

Carboxylic acids that may be used in accordance with the invention include mono- and dicarboxylic acids. Preferred monocarboxylic acids are those containing 1 to 30, especially 8 to 24, carbon atoms. (Where this specification indicates the number of carbon atoms in a carboxylic acid, the carbon atom(s) in the carboxylic group(s) is/are included in that number.) Examples of monocarboxylic acids are iso-octanoic acid, stearic acid, oleic acid, palmitic acid and behenic acid. Iso-octanoic acid may, if desired, be used in the form of the mixture of $C_8$ acid isomers sold by Exxon Chemicals under the trade name "Cekanoic". Other suitable acids are those with tertiary substitution at the α-carbon atom and dicarboxylic acids with more than 2 carbon atoms separating the carboxylic groups. Further, dicarboxylic acids with more than 35, for example, 36 to 100, carbon atoms are also suitable. Unsaturated carboxylic acids can be sulphurized. Although salicylic acids contain a carboxylic group, for the purposes of the present invention they are considered to be a separate group of surfactants, and are not considered to be carboxylic acid surfactants. (Nor, although they contain a hydroxyl group, are they considered to be phenol surfactants.)

Examples of other surfactants which may be used in accordance with the invention include the following compounds, and derivatives thereof: naphthenic acids, especially naphthenic acids containing one or more alkyl groups, dialkylphosphonic acids, dialkylthiophosphonic acids, and dialkyldithiophosphoric acids, high molecular weight (preferably ethoxylated) alcohols, dithiocarbamic acids, thiophosphines, and dispersants. Surfactants of these types are well known to those skilled in the art. Surfactants of the hydrocarbyl-substituted carboxylalkylene-linked phenol type, or dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, may also be suitable for use in the present invention; such surfactants are described in EP-A-708 171.

Further examples of detergents useful in the present invention are optionally sulphurized alkaline earth metal hydrocarbyl phenates that have been modified by carboxylic acids such as stearic acid, for examples as described in EP-A-271 262 (LZ-Adibis); and phenolates as described in EP-A-750 659 (Chevron).

Also suitable for use in the present invention are overbased metal compounds, preferably overbased calcium detergents, that contain at least two surfactant groups, such as phenol, sulphonic acid, carboxylic acid, salicylic acid and naphthenic acid, that may be obtained by manufacture of a hybrid material in which two or more different surfactant groups are incorporated during the overbasing process.

Examples of hybrid materials are an overbased calcium salt of surfactants phenol and sulphonic acid; an overbased calcium salt of surfactants phenol and carboxylic acid; an overbased calcium salt of surfactants phenol, sulphonic acid and salicylic acid; and an overbased calcium salt of surfactants phenol and salicylic acid.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

The hybrid detergent preferably includes at least 5 mass % of salicylate, more preferably at least 10 mass % of salicylate. The hybrid detergent preferably includes at least 5 mass % of phenate. The amount of salicylate and phenate in the hybrid detergent can be determined using techniques such as chromatography, spectroscopy and/or titration, well known to persons skilled in the art. The hybrid detergent may also include other surfactants such as sulphonate, sulphurized phenate, thiophosphate, naphthenate, or oil-soluble carboxylate. The hybrid detergent may include at least 5 mass % of sulphonate. The surfactant groups are incorporated during the overbasing process.

Particular examples of hybrid materials include, for example, those described in WO-A-97/46643; WO-A-97/46644; WO-A-97/46645; WO-A-97/46646; and WO-A-97/46647.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Preferably, the TBN of the hybrid detergent is at least 300 mg KOH/g, such as at least 330 mg KOH/g, more preferably at least 350 mg KOH/g, more preferably at least 400 mg KOH/g, most preferably in the range of from 400 to 600 mg KOH/g, such as up to 500 mg KOH/g, as determined by ASTM D2896.

Preferably, the amount of detergent in the lubricating oil composition is at least 0.5, preferably in the range of from 5 to 50, more preferably from 8 to 50, mass % based on the total amount of the lubricating oil composition.

The detergents may or may not be borated, and typically the boron contributing compound, e.g. the metal borate, is considered to form part of the overbasing. The detergent may include both a non-borated detergent and a borated detergent.

The detergents preferably have a sulphated ash content (as determined by ASTM D874) of at least 0.85%, more preferably at least 1.0% and even more preferably at least 1.2%.

The lubricating oil composition may include at least one dispersant. A dispersant is an additive for a lubricating composition whose primary function is to improve engine cleanliness.

A noteworthy class of dispersants is "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, e.g. polyisobutene succinic anhydride; and polyamine condensation products that may be borated or unborated.

If present, the dispersant is preferably present in an amount from 0.5 to 5 mass %, based on the total amount of the lubricant composition.

The lubricating oil composition may also include at least one anti-wear additive. The anti-wear additive may be metallic or non-metallic, preferably the former.

Dihydrocarbyl dithiophosphate metal salts are examples of the anti-wear additives. The metal in the dihydrocarbyl dithiophosphate may be an alkali or alkaline earth metal, or aluminium, lead, tin, molybdenum, manganese, nickel or copper. Zinc salts are preferred, preferably in the range of 0.1 to 1.5, preferably 0.5 to 1.3, mass %, based upon the total mass of the lubricating oil composition. They may be prepared in accordance with known techniques by firstly forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary and hydrocarbyl groups that are entirely primary. To make the zinc salt, any basic or neutral zinc compound may be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil-soluble salts of dihydrocarbyl dithiophosphoric acids and may be represented by the following formula:

$$[(RO)(R^1O)P(S)S]_2Zn$$

where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, I-propyl, n-butyl, I-butyl, sec-butyl, amyl, n-hexyl, I-hexyl, n-octyl, decyl, dodecyl, octadecyl, 2-ethylehexyl, phenyl, butylphenyl, cyclohexyl, methylcyclopentyl, propenyl, butenyl. In order to obtain oil-solubility, the total number of carbon atoms (i.e. in R and $R^1$) in the dithiophosphoric acid will generally be 5 or greater. The zinc dihydrocarbyl dithiophosphate can therefore comprise zinc dialkyl dithiophosphates.

If present, the anti-wear additive is preferably present in an amount from 0.10 to 3.0 mass %, based on the total amount of the lubricant composition.

The lubricating oil composition may also include at least one anti-oxidant. The anti-oxidant may be aminic or phenolic. As examples of amines there may be mentioned secondary aromatic amines such as diarylamines, for example diphenylamines wherein each phenyl group is alkyl-substituted with an alkyl group having 4 to 9 carbon atoms. As examples of anti-oxidants there may be mentioned hindered phenols, including mono-phenols and bis-phenols.

Preferably, the anti-oxidant, if present, is provided in the composition in an amount of up to 3 mass %, based on the total amount of the lubricant composition.

Other additives such as pour point depressants, anti-foamants, metal rust inhibitors, pour point depressants and/or demulsifiers may be provided, if necessary.

The terms 'oil-soluble' or 'oil-dispersable' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined individual (i.e. separate) components that may or may not remain the same chemically before and after mixing.

It may be desirable, although not essential, to prepare one or more additive packages or concentrates comprising the additives, whereby the additives can be added simultaneously to the oil of lubricating viscosity to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant.

Thus, the additives may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive packages(s), the remainder being base oil.

The present invention is illustrated by, but in no way limited to, the following examples.

EXAMPLES

Synthesis Example 1

Preparation of a Compound of Formula (II)

Step 1—Preparation of 2-(2-naphthyloxy)ethanol

A two-liter resin kettle equipped with mechanical stirrer, condenser/Dean-Stark trap, and inlets for nitrogen, was charged with 2-naphthol (600 g, 4.16 moles), ethylene carbonate (372 g, 4.22 moles) and xylene (200 g), and the mixture was heated to 90° C. under nitrogen. Aqueous sodium hydroxide (50 mass %, 3.0 g) was added and water was removed by azeotropic distillation at 165° C. The reaction mixture was kept at 165° C. for 2 hours. $CO_2$ evolved as the reaction progressed and the reaction was determined to be near completion when the evolution of $CO_2$ ceased. The product was collected and solidified while cooling to room temperature. The completion of reaction was confirmed by FT-IR and HPLC. The structure of the 2-(2-naphthyloxy) ethanol product was confirmed by 1H and $^{13}$C-NMR.

Step 2—Oligomerization of 2-(2-naphthyloxy) ethanol

A two-liter resin kettle equipped with mechanical stirrer, condenser/Dean-Stark trap, and inlets for nitrogen, was charged with 2-(2-naphthyloxy) ethanol from Step 1, toluene (200 g), SA 117 (60.0 g), and the mixture was heated to 70° C. under nitrogen. Para-formaldehyde was added over 15 min at 70-80° C., and heated to 90° C. and the reaction mixture was kept at that temperature for 30 min to 1 hour. The temperature was gradually increased to 110° C. to 120° C. over 2-3 hours and water (75-83 ml) was removed by azeotropic distillation. The polymer was collected and solidified while cooling to room temperature. $\overline{M}_n$ was determined by GPC using polystyrene standard corrected with the elution volume of 2-(2-naphthyloxy) ethanol as internal standard. THF was used as eluent. ($\overline{M}_n$ of 1000 dalton). $^1$H and $^{13}$C NMR confirmed the structure. FDMS and MALDI-TOF indicates the product contains mixture of methylene-linked 2-(2-naphthyloxy) ethanol oligomer of Formula (I) containing from 2 to 24 2-(2-naphthyloxy) ethanol units (m is 1 to 23).

Step 3—Reaction of Methylene-Linked 2-(2-naphthyloxy) ethanol Oligomer and an Acylating Agent (PIBSA)

A five-liter resin kettle equipped with mechanical stirrer, condenser/Dean-Stark trap, inlets for nitrogen, and additional funnel was charged with poly (2-(2-naphthyloxy) ethanol)-co-formaldehyde) from Step 2, toluene (200 g), and the mixture is heated to 120° C. under nitrogen. Polyisobutenyl succinic anhydride (PIBSA $\overline{M}_n$ of 450, 2,500 g) was added portion wise (~250 g at 30 min intervals) and the temperature was maintained at 120° C. for 2 hours followed by heating to 140° C. under nitrogen purge for an additional 2 hours to strip off all solvents to a constant weight. Base oil (AMEXOM 100 N, 1100 g) was added, and the product was collected at room temperature. GPC and FT-IR confirmed the desired structure.

The reaction scheme representing the above synthesis is shown below:

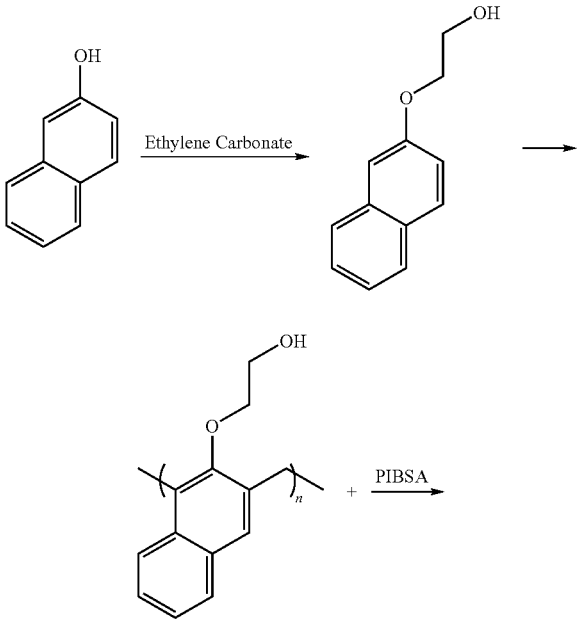

-continued

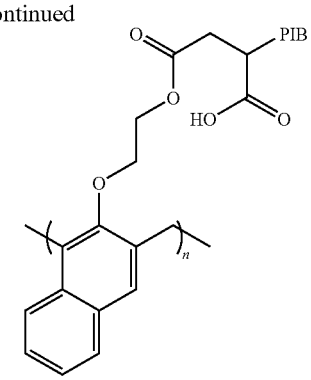

Performance Example 1

The following examples use a centrifuge water shedding test which evaluates the ability of an oil to shed water from a prepared test mixture of oil and water. The test uses an Alfa Laval MAB 103B 2.0 centrifuge coupled to a Watson Marlow peristaltic pump. The centrifuge is sealed with 800 ml of water. A measurement is made of the amount of deposits formed in the centrifuge during the test. Pre-measured amounts of water and the test oil are mixed together and then passed through the centrifuge at a rate of 2 litres/min. The test is run for an hour and a half, allowing the mixture to pass through the centrifuge about 10 times. The centrifuge is weighed before and after the test. A poor trunk piston diesel engine lubricant will produce a larger amount of deposits in the centrifuge system.

| | Comparative Example 1 | Comparative Example 2 | Example 3 |
|---|---|---|---|
| 225 BN calcium salicylate | 6.35 | 6.35 | 6.35 |
| 350 BN calcium salicylate | 4.48 | 4.48 | 4.48 |
| ZDDP | 0.36 | 0.36 | 0.36 |
| Diluent | 0.73 | 0.73 | 0.73 |
| Compound of formula (II) | — | — | 1.00 |
| PIBSA-PAM | — | 1.00 | — |
| GP II base oil | 70.46 | 69.66 | 69.66 |
| GP I bright stock | 17.62 | 17.42 | 17.42 |
| Alfa Laval Shedding Test Results | | | |
| Bowl Difference | 7 | 88 | 7 |
| Rating | Thin film of white/yellow deposit | Heavy emulsion | Patchy light brown deposits |
| Hood Difference | 1 | 1 | 1 |
| Rating | Oil film | Oil film | Oil film |
| Top Disc | 2 | 16 | 2 |
| Rating | Thin film of yellow | Heavy emulsion | Light brown deposits on rim |
| Disc & Dist Difference | 28 | 35 | 30 |
| Rating | Oil film | Heavy emulsion | Spots of brown deposits |
| Total Mass of Deposits measured, grams | 38 | 140 | 40 |

Comparative Example 1 does not include a dispersant and therefore exhibits good water separation. Comparative Example 2 includes a PIBSA-PAM dispersant and demonstrates that it causes an emulsion to form between the water and the lubricating oil composition which results in the production of a larger amount of deposits. Example 3, which is in accordance with the invention, shows that the use of the compound of formula (II) has little emulsifying effect and is comparable to the use of no dispersant. Therefore, Example 3 produces a smaller amount of deposits than Comparative Example 2. Thus, the compound of formula (II) is preferred over the use of PIBSA-PAM.

The invention claimed is:

1. A lubricating oil composition having a total base number of at least 15 mg KOH/g, as determined by ASTM D2896, the composition including:

at least 40 mass % of an oil of lubricating viscosity;

at least one overbased metal detergent; and at least one compound of the formula (II):

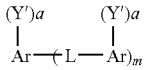

(II)

wherein:

each Ar independently represents an aromatic moiety having 0 to 3 substituents selected from the group consisting of alkyl, alkoxy, alkoxyalkyl, hydroxy, hydroxyalkyl, acyloxy, acyloxyalkyl, aryloxy, aryloxy alkyl, halo and combinations thereof;

each L is independently a linking moiety comprising a carbon-carbon single bond or a linking group;

each Y' is independently a moiety of the formula $Z(O(CR_2)_n)_yX$—, wherein X is selected from the group consisting of $(CR'_2)_z$, O and S; R and R' are each independently selected from H, $C_1$ to $C_6$ alkyl and aryl; z is 1 to 10; n is 0 to 10 when X is $(CR'_2)_z$, and 2 to 10 when X is O or S; y is 1 to 30; Z is H, an acyl group, an alkyl group or an aryl group;

each a is independently 0 to 3, with the proviso that at least one Ar moiety bears at least one group Y in which Z is not H; and m is 1 to 100.

2. The lubricating oil composition as claimed in claim 1, wherein Y' is $Z(O(CR_2)_2)_yO$—, Z is an acyl group and y is 1 to 6.

3. The lubricating oil composition as claimed in claim 1, wherein Ar is naphthalene, Y' is $ZOCH_2CH_2O$—, Z is an acyl group and L is $CH_2$.

4. The lubricating oil composition as claimed in claim 3, wherein Ar is derived from 2-(2-naphthyloxy)-ethanol and m is 2 to 25.

5. The lubricating oil composition as claimed in claim 1, wherein Z is derived from a polyalkyl or polyalkenyl succinic acylating agent having $\overline{M}_n$ of from about 100 to about 5000.

6. The lubricating oil composition as claimed in claim 1, wherein Z is derived from hydrocarbyl isocyanate.

7. A method of operating a trunk piston diesel engine, the method including the step of lubricating the engine with the lubricating oil composition as claimed in claim 1.

8. The method as claimed in claim 7, wherein said trunk piston diesel engine has a centrifuge system including a sealing medium.

9. The method as claimed in claim 8, wherein said sealing medium is water.

10. A method of reducing deposits in a trunk piston diesel engine, the method including the steps of lubricating the engine with the lubricating oil composition as claimed in claim 1, and operating the engine.

11. The method as claimed in claim 10, wherein said trunk piston diesel engine has a centrifuge system including a sealing medium.

12. The method as claimed in claim 11, wherein said sealing medium is water.

13. A method of improving asphaltene dispersancy in a trunk piston diesel engine, the method including the step of lubricating the engine with the lubricating oil composition as claimed in claim 1.

14. A method of operating a crosshead diesel engine, the method including the step of lubricating the engine crankcase with the lubricating oil composition as claimed in claim 1.

15. The method as claimed in claim 14, wherein said crosshead diesel engine has a centrifuge system including a sealing medium.

16. The method as claimed in claim 15, wherein said sealing medium is water.

17. A method of reducing deposits in a crosshead diesel engine, the method including the steps of lubricating the engine with the lubricating oil composition as claimed in claim 1, and operating the engine.

18. The method as claimed in claim 17, wherein said crosshead diesel engine has a centrifuge system including a sealing medium.

19. The method as claimed in claim 18, wherein said sealing medium is water.

* * * * *